US005423336A

United States Patent [19]

Mentzel et al.

[11] Patent Number: 5,423,336

[45] Date of Patent: Jun. 13, 1995

[54] VENTILATED FILTER CIGARETTE

[75] Inventors: Edgar Mentzel, Quickborn; Henning Seidel, Mechtersen; Wolfgang Wildenau, Bargfeld-Stegen, all of Germany

[73] Assignee: H.F. & Ph.F. Reemtsma GmbH & Co., Hamburg, Germany

[21] Appl. No.: 22,003

[22] Filed: Feb. 24, 1993

[30] Foreign Application Priority Data

Feb. 25, 1992 [DE] Germany ..... 42 05 658.6

[51] Int. Cl.[6] ..... A24D 3/00; A24D 3/04

[52] U.S. Cl. ..... 131/344; 131/342

[58] Field of Search ..... 131/342, 344, 331, 335, 131/336, 341

[56] References Cited

U.S. PATENT DOCUMENTS

| | | | |
|---|---|---|---|
| 3,353,543 | 11/1967 | Sproull et al. | 131/342 |
| 3,716,063 | 2/1973 | Litzinger | 131/342 X |
| 4,246,910 | 1/1981 | Rainer et al. | 131/342 X |
| 4,874,004 | 10/1989 | Borowski et al. . | |
| 5,103,844 | 4/1992 | Hayden et al. | 131/336 X |

FOREIGN PATENT DOCUMENTS

| | | | |
|---|---|---|---|
| 0321740 | 6/1989 | European Pat. Off. . | |
| 2355493 | 5/1974 | Germany . | |
| 2527569 | 9/1985 | Germany . | |
| 3635958 | 4/1987 | Germany . | |
| 4105500 | 6/1992 | Germany . | |
| 430547 | 8/1967 | Switzerland | 131/342 |
| 1410048 | 10/1975 | United Kingdom . | |
| 1507456 | 4/1978 | United Kingdom . | |
| 2183137 | 6/1987 | United Kingdom . | |

*Primary Examiner*—Jennifer Bahr
*Attorney, Agent, or Firm*—Foley & Lardner

[57] ABSTRACT

The invention relates to a ventilated filter cigarette having a filter with three chambers, including a middle chamber containing an adsorbent. The strand-side chamber next to the middle chamber achieves a high pressure drop and a low tar retention by means of a smoke-permeable flow passage, such as a core made from smoke-permeable cellulose acetate fibers, that is enclosed by a casing made from virtually smoke-impermeable cellulose acetate fibers.

16 Claims, 2 Drawing Sheets

VENTILATED FILTER CIGARETTE

FIELD OF THE INVENTION

The invention relates to a ventilated filter cigarette, particularly a cigarette having a three chambered filter.

BACKGROUND OF THE INVENTION

German patent publication DE-A1-36 35 958 discloses a ventilated filter cigarette with a triple filter in which the first core component adjoining the tobacco strand is a plastics film, made for example from polyethylene, which is corrugated in longitudinal direction. In this way, longitudinal ducts are formed which are essentially air- and smoke-impermeable in radial direction, with which a high pressure drop can be achieved with simultaneously low tar retention. Adjoining the first core component is a second core component, where appropriate with interposition of a middle chamber which features ventilation holes for the introduction of secondary air. The second core component is accordingly arranged in a mouth-side chamber and effects a small pressure drop with likewise relatively low tar retention. One disadvantage of this known cigarette, however, is that the strand-side core component is not environment-friendly, as it consists of a plastics film such as polyethylene. Another disadvantage is that made-to-measure production of this core component is technically costly.

European patent publication EP-B1-0 321 740 describes a ventilated coaxial filter cigarette with just one filter element in which the casing and the core filter the two different smoke flows flowing through them in a different way, but to a marked degree in each case.

Preferably, all of the primary smoke should be directed into carbon particles of an activated carbon filter. However, previously, it was not technically feasible to conduct all of the primary smoke directly into the carbon particles of an activated carbon filter.

In principle, the use of gas-phase-active material leads to an unwanted change in taste. Attempts have been made to limit this disadvantage, by coating the carbon particles as described in German Patent 2 527 569 or by using membranes made from vapor-permeable material, e.g. according to German Patent 2 355 493.

By means of a combination, described in detail in the copending patent application DE-A1-41 05 500, of (a) aromatization of the tobacco strand with a mixture of aromatic substances from two specific groups and (b) use of a specific adsorption agent and (c) making possible a specific ventilation and (d) combination of two filter elements, one achieves for example a gas-phase quantity which corresponds to a modern cigarette in the "ultra-light" range, of below 2 mg condensate/-cigarette, while the particle-phase quantity of this cigarette was found to lie in the "light" range with about 5 to 6 mg condensate/cigarette, added to which there is, overall, a good taste without "after-taste or charcoal taste". Express reference is made in the present invention to this effect—which means a dramatic reduction in the "after-taste or charcoal taste".

Objects of the present invention include further developing the known filter cigarette, which has the taste of a so-called "strong" cigarette, in such a way that all filter cores can be manufactured in a simple, tailor-made process from environment-friendly material. The primary smoke of the cigarette according to the invention is preferably directed, because of the design, into and through the adsorption granulate particles of the chamber filter, which makes possible an optimum gas-phase adsorption.

SUMMARY OF THE INVENTION

The invention relates to a ventilated filter cigarette including a cigarette body filled with tobacco strands and an improved filter tip at one end of the body. The filter tip comprises three chambers or filter sections wherein the strand-side section achieves a high pressure drop and a low tar retention. In particular, a ventilated filter cigarette of the invention includes a strand-side smoke-permeable filter section comprising a first casing that is virtually impermeable to primary smoke. The first casing has at least one lengthwise first flow passage therethrough, which first flow passage is permeable to primary smoke and has a cross-sectional area effective to enhance through-flow speeds of primary smoke in the strand-side filter section. The cigarette further has a mouth-side smoke-permeable filter section, and a middle chamber filled with an adsorption agent that removes an impurity from cigarette smoke, the middle chamber being disposed between the strand-side and mouth-side filter sections. An air-impermeable sheath encloses the strand-side filter section, the middle chamber, and the mouth-side filter section, the sheath having ventilation openings allowing air to enter the middle chamber. A second casing and second flow passage may be provided in the mouth-side filter section. The first and second flow passages through the respective casings may comprise open channels or ducts, or may comprise cores or annular sleeves of smoke-permeable filter materials, as described in detail below.

A ventilated filter cigarette according to one embodiment of the invention includes three chambers: a strand-side chamber having an air-permeable filter section, a mouth-side chamber, and a middle chamber filled with an adsorption agent disposed between the strand-side and the mouth-side chambers. The filter section has a core and a casing enclosing the core. The core is permeable for primary smoke and the casing is virtually impermeable for primary smoke. At least one air-impermeable sheath or tipping, having ventilated openings, encloses the three chambers.

The diameter of the filter core relevant for tar retention can thereby be reduced in such a way that higher throughflow speeds of the primary smoke result in this zone, with the consequence that the retention mechanisms of the diffusion effect and of the barrier effect decrease, while those of the inertia effect increase, so that, overall, a lower retention is achieved than with a customary filter. This can be achieved either through a filter core made from cellulose acetate fibers or through small channels or ducts which are formed from cellulose acetate film. Cellulose acetate is rottable and thus environment-friendly. The air-impermeable casing enclosing the cellulose acetate core can also be formed from cellulose acetate fibers, but these are much more highly compressed and are thus practically air-impermeable both in longitudinal direction and in radial direction. As channels or ducts can be molded or inserted without further sheaths into this air-impermeable casing made from compressed cellulose acetate fibers, the filter material for the whole strand-side core component continues to be environment-friendly.

The channels or ducts are arranged in the center of the first chamber, or can lie, in another version, mouth-side at the periphery of the largely air-impermeable, compressed cellulose acetate fibers. In either case, the cross-sectional area of the channels or ducts is generally less than about half of the total cross-sectional area of the filter tip, so that the through-flow speed of primary smoke through the channels or ducts is suitably increased.

The preferably impressed ducts arranged at the periphery in the mouth-side filter section can also be open to the outside, in which case they are then covered to the outside by the sheath of filter tipping paper. The outside-lying ducts can run rectilinearly or helically. Zig-zag patterns are also conceivable. In a preferred version, the middle chamber lying between the two core components is filled with activated carbon and provided with ventilation openings. The degree of filling of the middle chamber depends on the production possibilities. As a rule, the middle chamber can be filled with an amount of activated carbon that occupies only 60 to 80% of the volume. The ventilation openings are manufactured in the usual way, for example by laser perforation, by mechanical perforation with toothed rolls, electromechanically by corona discharge, or by using naturally porous tipping paper.

BRIEF DESCRIPTION OF THE DRAWING

The invention is explained in more detail below with references to drawings, wherein.

Identical parts are always provided with the same reference numbers in the various embodiments.

DETAILED DESCRIPTION OF THE PREFERRED EMBODIMENTS

Figure 1:
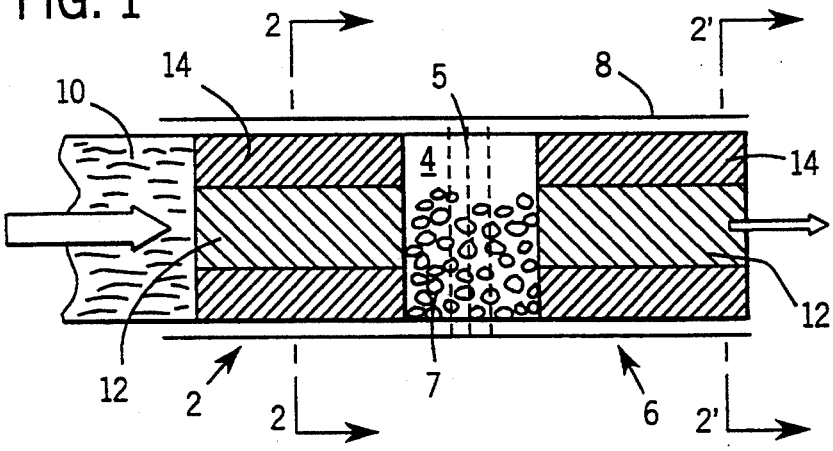
FIG. 1 is a diagrammatic longitudinal section through a first embodiment.

FIG. 1 shows a first embodiment, in which the cigarette body including the tobacco strand 10 is only indicated schematically. Adjoining the tobacco strand 10 is the filter tip with a first chamber (filter section) 2, a second chamber 4, and a third chamber (filter section) 6. The first chamber 2 is also known as the "strand-side" chamber, the second chamber 4, which adjoins it, as the "middle" chamber and the third chamber 6, which adjoins the middle chamber, as the "mouth-side" chamber. The three chambers 2, 4 and 6 and a part of the tobacco strand 10 are enclosed by a sheath 8 which is a filter tipping paper customary in cigarette manufacture. In the strand-side, first chamber 2 the core component is formed by an air-permeable core 12 made from cellulose acetate fibers, which is permeable for the primary smoke. The core 12 is enclosed by a practically air-impermeable casing 14 made from highly compressed cellulose acetate fibers which, just like the material for the core 12, are rottable (i.e. biodegradable) and thus environment-friendly.

The compression of the cellulose acetate fibers of the casing 14 is chosen in such a way that virtually no primary smoke can flow through. The central position and the suitable choice of the diameter of core 12 mean that, on the one hand, a desired high pressure drop can be achieved in the primary smoke with simultaneously low tar retention and, on the other hand, the primary smoke flowing through the core 12 is inevitably guided in every cigarette position through an adsorption agent 7, preferably activated carbon, located in the central chamber 4.

The second chamber 4 is filled up to 95% with the adsorption agent 7. The adsorption agent 7 is preferably made from activated carbon with a pore volume of 0.7 to 0.8 $cm^3/g$, a pore radius of 0.9 to 1 nm and a grain-size distribution corresponding to a screen mesh width in the range from 177$\mu$ to 500 $\mu$m.

To eliminate the unwanted adverse effects, on taste, mentioned above, specific aromatic substances can be applied both into the tobacco mixture and onto the filter material. Details of this are described in German patent application DE-A1-41 05 500, which is incorporated by reference.

The secondary air entering the chamber 4 through ventilation openings 5 is mixed there with the primary smoke and then leaves through the mouth-side chamber 6, which in this embodiment is built in a manner identical to the first chamber 2, i.e. it likewise has an air-permeable core 12 made from cellulose acetate fibers, which are enclosed by a virtually air-impermeable casing 14.

Figure 2:
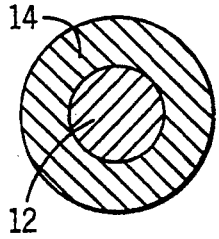
FIG. 2 is a section along the lines 2—2 and 2'—2' through the embodiment according to FIG. 1.

FIG. 2 shows a section through the first chamber 2 along the line 2—2. The section 2—2 also corresponds to the section 2'—2' through the third chamber 6. One recognizes the central core 12, which has a circular cross-section and is made from air-permeable cellulose acetate fibers or other degradable fibers, which are enclosed by an annular casing 14 made from virtually air-impermeable, rottable material, preferably tightly compressed cellulose acetate fibers. In this way, the primary smoke can flow out from the tobacco strand 10 only through the central core 12. As the cellulose acetate arranged or laid out according to the invention has a low tar retention, tar retention is relatively small in both chambers 2 and 6.

Figure 3:
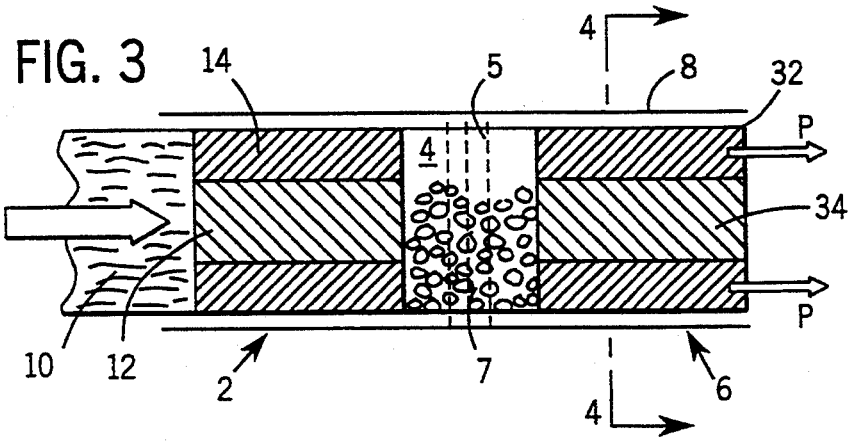
FIG. 3 is a diagrammatic longitudinal section through a second embodiment.

FIG. 3 shows another embodiment, in which the core component in the mouth-side chamber 6 is designed inversely in relation to the strand-side chamber 2. The filter otherwise corresponds to that of FIG. 1, i.e. the first and second chambers 2 and 4 correspond to those of the first embodiment. In the embodiment according to FIG. 3, the core component of the mouth-side chamber has an air-impermeable core 34 which is enclosed by an air-permeable casing 32.

Figure 4:
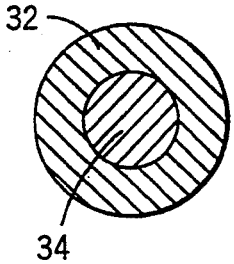
FIG. 4 is a section along the line 4—4 through the embodiment of FIG. 3.

FIG. 4 shows a section 4—4 through the core component of the mouth-side chamber 6 of FIG. 3. It will be seen that the air-impermeable core 34, made from, for example, compressed cellulose acetate fibers, is enclosed by an annular casing 32 made from, for example, uncompressed cellulose acetate fibers which expediently are air-permeable in longitudinal direction of the filter. As a result, the primary smoke flowing centrally through the first chamber 2, having passed through the central chamber 4, is widened in the form of a ring for entry into the mouth-side chamber 6 and flows in the form of a ring outwards in the direction of the arrows P.

Figure 5:
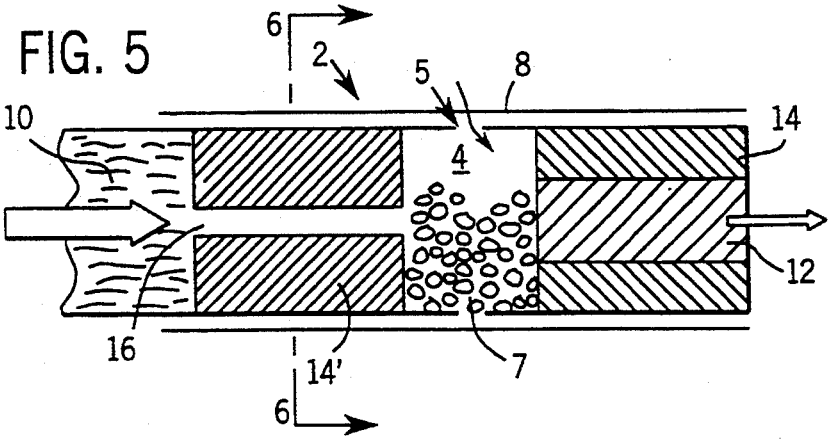
FIG. 5 is a diagrammatic longitudinal section through a third embodiment.

FIG. 5 shows a second version of the strand-side core component, in which a central small duct 16 is molded into a body 14', the latter being made from virtually air-impermeable material, which completely fills the chamber 2. The air-impermeable body 14' again consists of highly compressed cellulose acetate fibers which can rot and are thus environment-friendly. The primary smoke cannot flow through the compressed cellulose acetate fibers, neither in axial nor radial direction and thus must flow through the central duct 14' into the middle chamber 4.

Figure 6:
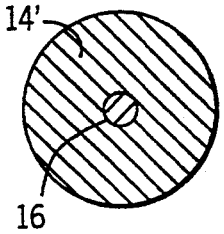
FIG. 6 is a section along the line 6—6 through the embodiment of FIG. 5.

FIG. 6 shows a section along the line 6—6 in FIG. 5 through the strand-side chamber 2. It is immediately clear from FIGS. 5 and 6 that the main flow smoke flows through the central duct 16 into the middle chamber 4 and impacts there on the activated carbon located therein. Another route is barred to the primary smoke, as the body 14', made from compressed cellulose acetate fibers, is virtually air-impermeable. This produces a sufficiently high pressure drop with simultaneously low tar retention.

The mouth-side chamber 6 is formed by a core component as in the case of the embodiment according to FIG. 1, i.e. by a central core 12 made from air-permeable cellulose acetate fibers which are enclosed by a casing 14 made from compressed and thus virtually air-impermeable cellulose acetate fibers.

Figure 7:
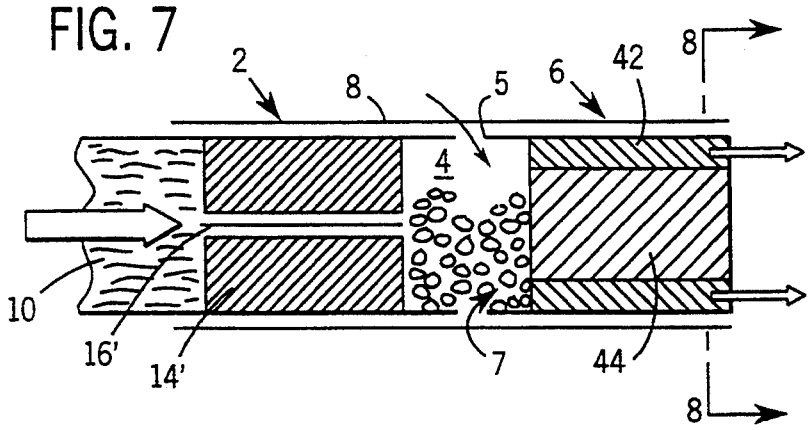
FIG. 7 is a diagrammatic longitudinal section through a fourth embodiment.

FIG. 7 shows another embodiment, in which the core component of the strand-side chamber 2 corresponds to that of FIG. 5, while the core component of the mouth-side chamber 6 is similar to that of FIG. 3, i.e. an almost air-impermeable core 44 is surrounded by a casing 42 of air-permeable cellulose acetate fibers. The filter material of the casing 32 or 42 or core 12 of the mouth side chamber 6 may also be made of a corrugated film made from cellulose acetate.

Figure 8:
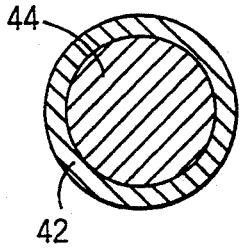
FIG. 8 is a section along the line 8—8 through the embodiment of FIG. 7.

FIG. 8 shows a section along the line 8—8 through the mouth-side chamber 6 of the embodiment of FIG. 7. It will be seen that the compressed, virtually air-impermeable core 44, made from cellulose acetate fibers, has a relatively large diameter compared with that according to the version of FIG. 4. This indicates that, through choice of the individual filter core cross-sections, the through-flow speeds and thus the pressure drop are adjustable by the expert according to the desired characteristics of the cigarette. Also with this embodiment, the primary smoke flows centrally into the middle chamber 4, in which it impacts on the activated carbon, charged for example with aromatic substances according to the invention, is mixed with secondary air and flows out in the form of a ring through the casing 42 of the mouth-side core component.

Figure 9:
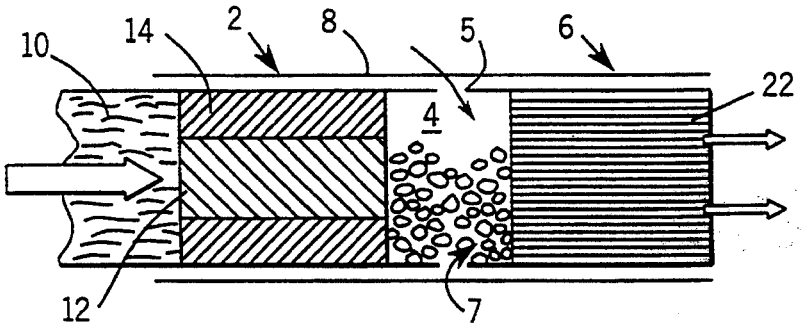
FIG. 9 is a diagrammatic longitudinal section through a fifth embodiment.

FIG. 9 shows another embodiment, in which the core component of the strand-side chamber 2 corresponds to that of FIG. 1, i.e. an air-permeable core 12 made from rottable cellulose acetate fibers is enclosed by a virtually air-impermeable casing 14 made from compressed cellulose acetate fibers. The primary smoke thus flows in the middle or centrally into the middle chamber 4, which is filled with activated carbon. In the latter, it is mixed with secondary air through the ventilation. openings 5, as in the case of the other embodiments. The smoke exits the middle chamber 4 through a customary mouth-side core component 22, made from cellulose acetate fibers, with a relatively low overall denier in the range of, for example 17000 to 35000 denier. A relatively low pressure drop thus obtains in the mouth-side chamber 6 with simultaneously low tar retention.

Figure 10:
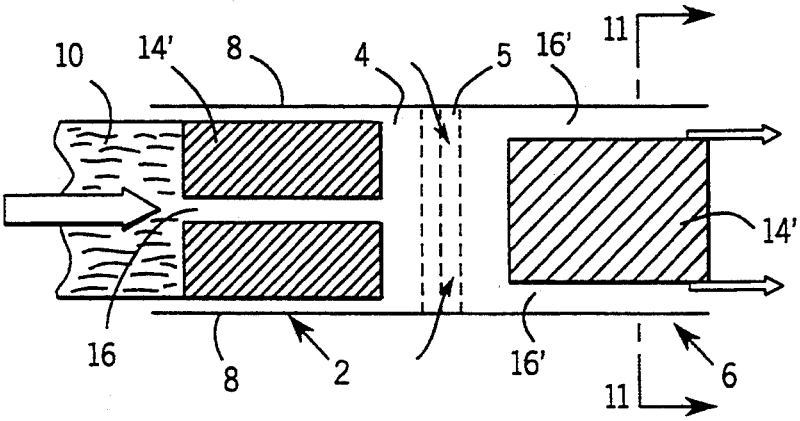
FIG. 10 is a diagrammatic longitudinal section through a sixth embodiment.

FIG. 10 shows a further embodiment having a strand-side chamber 2 and a middle chamber 4 as in the embodiment of FIG. 5, but with a mouth-side chamber 6 having a body 14' made of a material which is almost impermeable for smoke or air. Said body 14' is provided with longitudinal channels 16' in its peripheral region.

Figure 11:
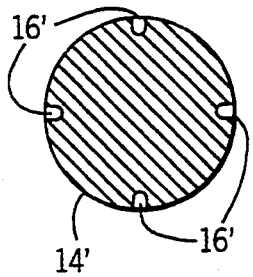
FIG. 11 is a section along the line 11—11 through the embodiment of FIG. 10.

FIG. 11 shows a section along the line 11—11 through the mouth-side chamber 6 of the embodiment of FIG. 10. One can see four channels 16' which are molded into the outer periphery of the practically air-permeable body or core 14' which completely fills the third chamber 6. The core 14' is made of compressed cellulose acetate fibers. The channels 16' extend in one embodiment rectilinearly throughout the third chamber 6; in another embodiment the channels 16' extend helically or in a zig-zag pattern throughout chamber 6.

It is to be noted that one skilled in the art can combine the filter structures of the first and third chambers in yet another way as disclosed in the drawings or described in the specification without departing from the concept or spirit of this invention.

We claim:

1. In a ventilated filter cigarette including a cigarette body filled with tobacco strands and a filter tip at one end thereof, the improvement wherein the filter tip comprises:

a strand-side air-permeable filter section, comprising a first casing that is virtually impermeable to primary smoke, which first casing has at least one lengthwise first smoke flow passage therethrough, which first flow passage is permeable to primary smoke, is formed from cellulose acetate fibers which are permeable for primary smoke and has a cross-sectional area effective to enhance through-flow speeds of primary smoke in the strand-side filter section;

a mouth-side air-permeable filter section;

a middle chamber filled with an adsorption agent that removes an impurity from cigarette smoke, the middle chamber being disposed between the strand-side and mouth-side filter sections; and an air-impermeable sheath enclosing the strand-side filter section, the middle chamber, and the mouth-side filter section, the sheath having ventilation openings allowing air to enter the middle chamber.

2. The cigarette of claim 1, wherein the middle chamber is filled up to 95% with the adsorption agent.

3. The cigarette of claim 2, wherein the adsorption agent is made from activated carbon with a pore volume of 0.7 to 0.8 $cm^3/g$, a pore radius of 0.9 to 1 nm and a grain-size distribution corresponding to a screen mesh width in the range from 177$\mu$ to 500 $\mu$m.

4. The cigarette of claim 1, wherein the mouth-side filter section comprises a second casing that is virtually impermeable to primary smoke, which second casing has at least one lengthwise second flow passage therethrough, which second flow passage is permeable to smoke and has a cross-sectional area effective to enhance through-flow speeds of smoke in the mouth-side filter section.

5. The cigarette of claim 4, wherein the second flow passage has an annular shape and is concentrically disposed outside of the second casing between the second casing and the sheath.

6. The cigarette of claim 5, wherein the second flow passage is formed from smoke-permeable fibers.

7. The cigarette of claim 1, wherein the strand-side filter section, the mouth-side filter section and the sheath are each made of biodegradable materials.

8. The cigarette of claim 1, wherein the first flow passage extends axially through the center of the strand-side filter section.

9. The cigarette of claim 4, wherein the first and second flow passages are each formed from cellulose acetate fibers which are permeable for primary smoke, and each extend axially through the center of the respective filter sections.

10. The cigarette of claim 9, wherein the adsorption agent is made from activated carbon.

11. In a ventilated filter cigarette including a cigarette body filled with tobacco strands and a filter tip at one end thereof, the improvement wherein the filter tip comprises:

a strand-side air-permeable filter section, comprising a first casing that is virtually impermeable to primary smoke, which first casing has at least one lengthwise first smoke flow passage therethrough, which first flow passage is permeable to primary smoke and has a cross-sectional area effective to enhance through-flow speeds of primary smoke in the strand-side filter section;

a mouth-side air-permeable filter section, wherein the mouth-side filter section comprises a second casing that is virtually impermeable to primary smoke, which second casing has at least one lengthwise second flow passage therethrough, which second flow passage is permeable to smoke and has a cross-sectional area effective to enhance through-flow speeds of smoke in the mouth-side filter section, and wherein the second flow passage is comprised of smoke-permeable cellulose acetate fibers or corrugated film made from cellulose acetate;

a middle chamber filled with an adsorption agent that removes an impurity from cigarette smoke, the middle chamber being disposed between the strand-side and mouth-side filter sections; and an air-impermeable sheath enclosing the strand-side filter section, the middle chamber, and the mouth-side filter section, the sheath having ventilation openings allowing air to enter the middle chamber.

12. The cigarette of claim 11, wherein the first flow passage is formed from cellulose acetate fibers which are permeable for primary smoke.

13. The cigarette of claim 11, wherein the first flow passage is comprised of at least one narrow open duct extending through the strand-side filter section.

14. The cigarette of claim 13, wherein the duct comprising the first flow passage extends axially through the center of the strand-side filter section.

15. The cigarette of claim 11, wherein the second flow passage extends axially through the center of the mouth-side filter section.

16. In a ventilated filter cigarette including a cigarette body filled with tobacco strands and a filter tip at one end thereof, the improvement wherein the filter tip comprises:

a strand-side air-permeable filter section, comprising a first casing that is virtually impermeable to primary smoke, which first casing has at least one lengthwise first smoke flow passage therethrough, which first flow passage is permeable to primary smoke and has a cross-sectional area effective to enhance through-flow speeds of primary smoke in the strand-side filter section;

a mouth-side air-permeable filter section, wherein the mouth-side filter section comprises a second casing that is virtually impermeable to primary smoke, which second casing has at least one lengthwise second flow passage therethrough, which second flow passage is permeable to smoke and has a cross-sectional area effective to enhance through-flow speeds of smoke in the mouth-side filter section, and wherein the first and second flow passages are each formed from smoke-permeable fibers;

a middle chamber filled with an adsorption agent that removes an impurity from cigarette smoke, the middle chamber being disposed between the strand-side and mouth-side filter sections; and an air-impermeable sheath enclosing the strand-side filter section, the middle chamber, and the mouth-side filter section, the sheath having ventilation openings allowing air to enter the middle chamber.

* * * * *